United States Patent [19]

Hultman et al.

[11] 4,053,352

[45] Oct. 11, 1977

[54] METHOD FOR PRODUCING OXIDIZED WHITE LIQUOR

[75] Inventors: Bengt Goran Hultman, Domsjoverken; Sture Erik Olof Noreus, Husum, both of Sweden

[73] Assignee: Mo och Domsjo Aktiebolag, Ornskoldsvik, Sweden

[21] Appl. No.: 679,945

[22] Filed: Apr. 26, 1976

Related U.S. Application Data

[63] Continuation of Ser. No. 490,530, July 22, 1974, abandoned.

[30] Foreign Application Priority Data

July 25, 1973 Sweden ..... 7310328

[51] Int. Cl.[2] ..... D21C 11/00

[52] U.S. Cl. ..... 162/29; 55/71; 162/30 K; 162/65; 162/82; 210/63 R; 423/514

[58] Field of Search ..... 162/82, 29, 30, 35, 162/65, 87, 67; 423/514; 210/63; 55/71

[56] References Cited

U.S. PATENT DOCUMENTS

| | | | |
|---|---|---|---|
| 2,759,783 | 9/1973 | Samuelson et al. | 162/65 |
| 3,269,095 | 8/1966 | Brannland | 55/71 |
| 3,652,407 | 3/1972 | Paleos | 162/30 R |
| 3,653,824 | 4/1972 | Barker et al. | 162/82 |
| 3,723,242 | 3/1973 | Barker | 162/82 |
| 3,888,967 | 6/1975 | Anderson et al. | 423/514 |

FOREIGN PATENT DOCUMENTS

| | | | |
|---|---|---|---|
| 529,238 | 8/1956 | Canada | 423/514 |

OTHER PUBLICATIONS

Rydholm, "Pulping Processes" (1965) pp. 429 and 473.

*Primary Examiner*—Robert L. Lindsay, Jr.
*Assistant Examiner*—George C. Yeung

[57] ABSTRACT

A cyclic process is provided for utilizing sodium values in sulfate cellulose pulping, in which sodium losses normally are less than sodium additions to the process, thus tending to build up a sodium surplus, and which includes the steps of pulping cellulosic material with a pulping liquor comprising sodium hydroxide and sodium sulfide, separating spent pulping black liquor, evaporating and combusting the black liquor to recover sodium values as sodium sulfide and sodium carbonate, dissolving the sulfide and sodium carbonate in water to form green liquor, causticizing the green liquor with calcium hydroxide to form white liquor, and recycling white liquor to form pulping liquor, the improvement comprising maintaining sodium balance at least in part by removing sodium values as white liquor, oxidizing the white liquor with air at an elevated temperature, and utilizing the oxidized white liquor as a source of alkali in another cellulose pulp treatment process.

19 Claims, 6 Drawing Figures

Flue gas
Sodium sulphate dust
Electro-static-filter
30
Soda recovery furnace
20
Green liquor
22
Flue gas
Slaking
28
Lime kiln
26
Ca(OH)2
Causti-cization
24
Strong black liquor
Sulphurous gases
16
Wood
Digester
10
Washing
12
Screening
14
Washing losses
Black liquor
Evapora-tion
18
Condensate
Na OH
Cl2
SO2
36
Chlorine dioxide process
34
Bleaching
Cellulose
32
Bleaching waste liquor
Residual acid

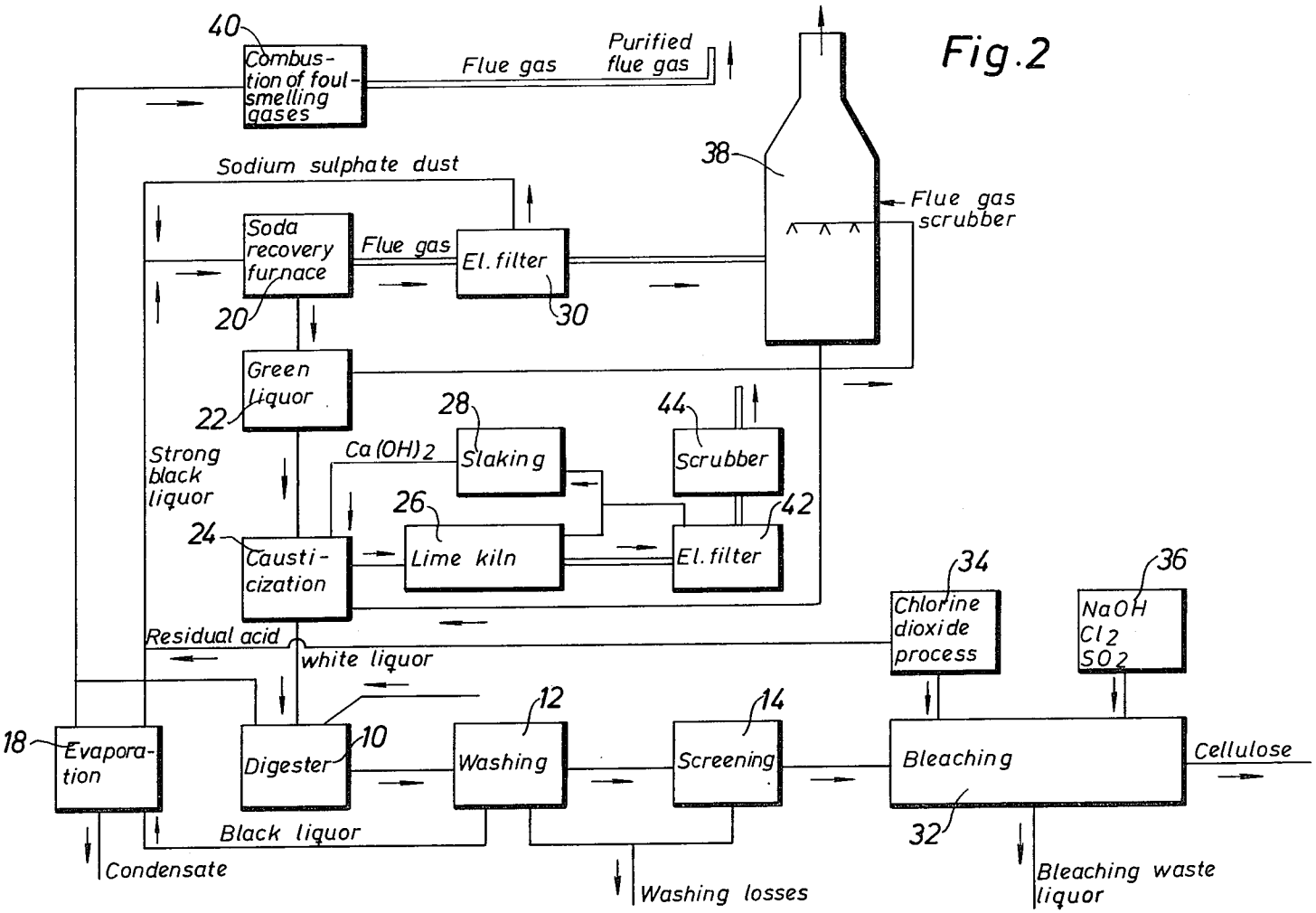
Fig.2
Flue gas scrubber
38
Purified flue gas
Flue gas
Combustion of foul-smelling gases
40
Sodium sulphate dust
El. filter
30
Flue gas
Soda recovery furnace
20
Green Liquor
22
Strong black liquor
Scrubber
44
El. filter
42
Slaking
28
Ca(OH)2
Lime kiln
26
Causti-cization
24
Residual acid
white liquor
NaOH
Cl2
SO2
36
Chlorine dioxide process
34
Bleaching
32
Cellulose
Bleaching waste liquor
Screening
14
Washing losses
Washing
12
Digester
10
Black liquor
Evapora-tion
18
Condensate $Na_2S$ g/l
40
30
20
10
9
7
1
5
6
2
8
3
4
30
60
90
120
min.
Oxidation period Na2S g/l Test no.
Sign.
1
2
3
4
5
50
40
30
20
10
50
100
min.
Reaction time Na2S g/l Air flow 15 Nm3/h
Air flow 35 Nm3/h
50
40
30
20
10
50
100
150
min.
Residence time

METHOD FOR PRODUCING OXIDIZED WHITE LIQUOR

This is a continuation of application Ser. No. 490,530, filed July 22, 1974, now abandoned.

It has been suggested that white liquor could be used as a source of sodium hydroxide for cellulose treatment and other related processes carried out in a cellulose plant other than the digestion of pulp. The concept of using white liquor instead of pure sodium hydroxide in whole or in part in an alkali extraction step in cellulose bleaching is old. In order to eliminate the risk of hydrogen sulphide formation when using white liquor in a bleaching step at a pH below 10, it has been proposed that white liquor should be oxidized in equipment similar to a black liquor oxidation plant, operating according to the foaming principle to provide a long contact time between gas and liquid. The foaming principle is, however, much more successful with black liquor than with white liquor, which has little or no foaming ability. Attempts to oxidize sulphide solutions in the laboratory have shown that it is difficult to oxidize sodium sulphide. A high pressure and a high temperature together with long reaction times are required.

Tests carried out in conjunction with the development of the present invention have also shown that the use of white liquor in bleaching processes has other disadvantages besides the generation of hydrogen sulphide. The use of white liquor both with oxygen-bleaching processes and conventional chlorine and/or chlorine dioxide bleaching processes impairs the pulp, viz. affects the brightness and viscosity of the pulp. Thus, the use of white liquor is often prohibited, even though the pH in the bleaching step is greater than 10.

The present invention provides a simple and practical method whereby white liquor can be oxidized with an oxygen-containing gas, such as air, to convert practically all sulphides to thiosulphate, thereby enabling the thus-treated white liquor to be used in many different processes without the aforementioned disadvantages. The oxidized white liquor can be used, for example:

1. in the purification of flue gases from a sodium recovery boiler;
2. in the purification of other gases containing sulphur or chlorine compounds;
3. in oxygen-bleaching processes;
4. in bleaching processes using chlorine and/or chlorine dioxide;
5. in the regeneration of ion exchangers;
6. for destroying chlorine or chlorine dioxide residues in waste liquids and gases obtained from bleaching or chlorine dioxide processes; and
7. for neutralizing sulphite waste liquor in conjunction with alcohol fermentation processes and evaporation processes.

The oxidized white liquor can in fact be used in any process where alkali is required, and where thiosulphate does not interfere with the process. Thus, it is not suitable to use oxidized white liquor as an alkali in peroxide bleaching processes, since the peroxide reacts with thiosulphate. It is also not suitable to use oxidized white liquor for the manufacture of hypochlorite, since chlorine and hypochlorite react with thiosulphate.

It should be noted that the negative effect obtained with respect to the quality of the pulp when using non-oxidized white liquor is not obtained when oxidized white liquor is used in the bleaching step.

In accordance with the present invention, a cyclic process is provided for utilizing sodium values in sulfate cellulose pulping, in which sodium losses normally are less than sodium additions to the process, thus tending to build up a sodium surplus, which includes the steps of pulping cellulosic material with a pulping liquor comprising sodium hydroxide and sodium sulfide, separating spent pulping black liquor, evaporating and combusting the black liquor to recover sodium values as sodium sulfide and sodium carbonate, dissolving the sulfide and sodium carbonate in water to form green liquor, causticizing the green liquor with calcium hydroxide to form white liquor, and recycling white liquor to form pulping liquor. The process maintains sodium balance at least in part by removing sodium values as white liquor, oxidizing the white liquor with air at an elevated temperature, and utilizing the oxidized white liquor as a source of alkali in another cellulose pulp treatment process.

Preferably, according to the invention, the white liquor is oxidized at a temperature within the range from about 50° to about 130° C by injecting air into the solution while maintaining the air flow at a rate to agitate the solution within the range from about 50 to about 500 $Nm^3/hm^2$ wherein N represents standard or normal, $m^3$ represents cubic meters, *h* represents hours, and $m^2$ represents square meters.

In a preferred embodiment of the invention the sodium values in the spent oxidized white liquor from the other cellulose pulp treatment process are recovered by combining the spent oxidized white liquor with spent pulping black liquor, and then recovering the sodium values of both.

It is also suitable to maintain the sulphur values in balance in conjunction with sodium values by removing sodium and sulphur values as white liquor. The white liquor can be used in the purification of flue gases from black liquor combustion and the oxidized white liquor can be used in an alkaline oxygen gas bleaching process. It is also possible to use the oxidized white liquor in a cellulose pulp bleaching process utilizing a chlorine compound and the oxidized white liquor may also be used to destroy chlorine residues in waste gases obtained from cellulose pulp bleaching process or to regenerate an ion exchanger or to neutralize sulphite waste liquor.

In another preferred embodiment the white liquor is oxidized at a temperature within the range from about 70° to about 110° C, in one or more reactors connected in series, by injecting air into the liquor in a manner to maintain the white liquor in motion, the pressure of the air at the top of the reactor exceeding atmospheric pressure by at most 5 bars and the air load being within the range from about 100 to about 400 $Nm^3/hm^2$ calculated on the projected bottom surface of the reactor, and the oxidized solution, optionally after purifying the same, is used as an alkali for purposes other than the preparation of cooking liquor.

So that the invention may be more readily understood and other features thereof made apparent, a method according to the invention will now be described with reference to the accompanying drawings, in which:

FIG. 2 is a flow scheme showing the unit operations in a sulphate pulp manufacturing plant of more modern construction;

Among the advantages gained by using oxidized white liquor in cellulose treatment processes is the low price of sodium hydroxide in the oxidized white liquor, compared with sodium hydroxide produced externally according to the amalgam or diaphragm method. Another important advantage afforded by using oxidized white liquor is that the chemical balance of the system can be influenced and regulated within the sulphate plant.

To illustrate the problem associated with chemical balance, three cases will be described schematically, with reference to FIGS. 1 to 3.

Figure 1:
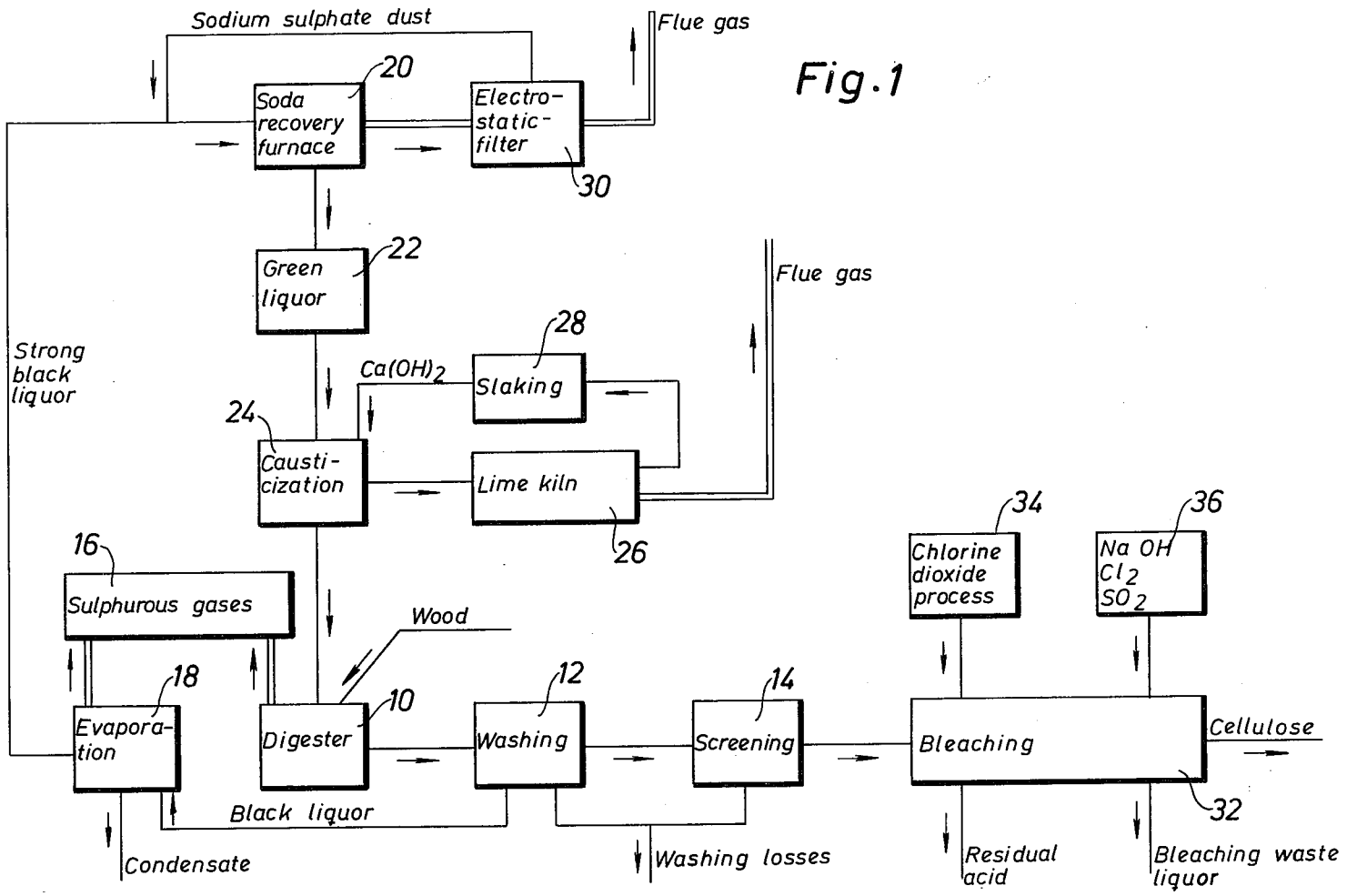
FIG. 1 is a flow scheme showing the unit operations in a conventional sulphate pulp manufacturing plant.

With the conventional plant shown in FIG. 1, wood chips are treated in the digester 10 with a cooking liquor, white liquor, containing mainly sodium sulphide and sodium hydroxide and minor quantities of other sodium and sulphur compounds. If a satisfactory cooking result is to be obtained, the sulphidity, i.e., the quotient $$\frac{Na_2S}{Na_2S + NaOH},$$

calculated as moles Na, must have a certain value. Normally, a sulphidity of from 25 to 40% is desired. An excessively high sulphidity is undesirable, since the percentage of sodium hydroxide then falls. Neither is an excessively low sulphidity desirable. In this latter instance, the cooking process begins to take the character of another type of process, the so-called soda cooking process. It is therefore suitable to maintain the sulphidity constant, and at a suitable level.

Upon completion of the digestion process, the digested chips or pulp are freed from cooking liquor in the washing 12, in which the pulp is washed with water. The loss of a certain amount of sodium, sulphur and dissolved organic substances in the washing process is unavoidable. The pulp is then removed from the washing 12 and screened at 14 with water, wherein further chemical losses occur; the total losses obtained from the washing and screening of the pulp are called "washing losses". Another loss is that incurred in the formation of foul-smelling sulphurous gases 16 during the cooking or digestion process. These gases can be destroyed by combustion in a furnace, the sulphur being recovered as sulphur dioxide. At present it is normal practice to release the sulphur dioxide-containing gas to atmosphere.

The recovered spent cooking liquor, black liquor, is evaporated at 18 to a solids content of approximately 65%. During the evaporation process, some of the sulphur compounds are liberated, and some of the black liquor is carred over to the condensate. The liberated gaseous sulphur compounds are foul-smelling and poisonous. They can be destroyed by combustion in the same way as the gases obtained from the cooker.

The evaporated black liquor, strong black liquor, is combusted in a soda recovery furnace 20, from which a melt is obtained containing mainly sodium sulphide and sodium carbonate. The melt is dissolved in water, a green liquor 22 being obtained. When treating green liquor with calcium hydroxide, a treatment process called causticizing as shown in 24, the sodium carbonate is converted to sodium hydroxide. The resulting liquor is called white liquor, which is the liquor used for sulphate cooking processes. The calcium carbonate formed simultaneously with the white liquor is separated therefrom, and calcined in a lime kiln 26 to form calcium oxide, which after being slaked at 28 with water forms calcium hydroxide, which can be re-used for causticizing purposes.

The soda recovery boiler gives off flue gases which contain dust, mainly in the form of sodium sulphate, and gases comprising sulphur dioxide, hydrogen sulphide and nitrogen, carbon dioxide and water or steam. The dust is recovered in electrostatic filter 30, and is returned to the chemical cycle. The flue gas can be treated in a flue gas scrubber, the major portion of the sulphur dioxide content being recovered and returned to the chemical cycle.

The washed and screened pulp is bleached in the bleaching section 32, with which is associated a chlorine dioxide process 34 for producing chlorine dioxide for the bleaching process. NaOH, $Cl_2$ and $SO_2$ are passed to the bleaching section from 36. The bleaching section is provided with outlets for the residual acid from the chlorine dioxide process, and/or other substances to be discharged from said section.

FIG. 1 illustrates schematically the conditions in a conventional sulphate plant with a fairly open system. FIG. 2 shows a plant having a more closed system, made necessary by environmental requirements. In the system of FIG. 2, flue gas from the soda recovery boiler 20 is washed in a scrubber 38 subsequent to being treated in an electrostatic filter 30, sulphur being recovered by the process. The foul-smelling gases obtained from the digester and from the evaporation process are combusted at 40. The flue gas obtained at 40 can also be treated in a scrubber as 38 for the recovery of sulphur. The losses from the washing 12 and screening 14 are reduced. Residual acid from the chlorine dioxide manufacturing process at 34 is returned to the strong black liquor. The flue gases from the lime kiln 26 are also treated in an electrostatic filter 42 and a scrubber 44. Other conceivable steps include the return of bleaching waste liquor from an oxygen-gas bleaching step to the black liquor system, and the treatment of the discharge from chlorine and/or chlorine dioxide bleaching steps for combustion of the dry substance recovered therewith.

The steps taken to depart from the relatively open system to the more closed system involve a substantial reduction in the discharge of both sodium and sulphur. In addition there is a large addition of sodium and sulphur from the residual acid obtained from the chlorine dioxide manufacturing process and the return of sodium from the oxygen-gas bleaching process.

The problem with the chemical balance is that the quotient between sodium and sulphur in the cooking liquor is determined by the need to operate within a certain sulphidity interval, and that the quantity of chemicals recovered should coincide with the quantity of chemicals required for the cooking process. An increase in sulphidity as a result of too much sulphur being recovered can be overcome by rejecting sodium sulphate at the electrostatic filter and by adding sodium carbonate or sodium hydroxide. If the sulphidity is low, sodium sulphate can be added to increase the sulphidity.

It will readily be perceived that it is more difficult to maintain the correct balance between sulphur and sodium in the closed system with small losses than in the open system with large losses. In the closed system a small change in the chemical losses or in the addition of chemicals can seriously disturb the chemical balance. Another important factor which must be observed in the closed system is the risk of increasing chloride content in the cooking liquor and the subsequent corrosion problems caused by, inter alia, the chloride content of the wood and the returned residual acid containing chloride and chlorate. When the returned chemicals pass through the soda recovery boiler, the chlorate is converted to chloride.

This development, involving a high degree of recovery of the chemicals in existing processes and the recovery of chemicals which, for various reasons, have not been previously useable, can reach a position in which the chemical balance is difficult to control. To illustrate this, an example is given below for the sodium balance of a sulphate plant used for the manufacture of fully bleached pulp.

| Sodium Balance (calculated per ton of pulp) | | |
|---|---|---|
| | kg $Na_2SO_4$ | kg Na |
| Total sodium losses | 30 | 9.7 |
| | kg $Na_2SO_4$ | kg Na |
| Supply of Sodium | | |
| 1 Residual acid from chlorine dioxide manufacturing process | 36 | 11.7 |
| 2 Recovery of oxygen bleaching waste liquor | 50 | 16.2 |
| 3 The washing of flue gases in a scrubber | 33 | 10 |

It is evident from this that in a closed system there is great disparity between the sodium supplied to the system and that discharged therefrom. A similar disparity in balance can be shown for sulphur, the conclusion being that there is a surplus of sulphur, mainly due to the fact that residual acid is returned to the system.

The chemical surplus can be removed from the system in a number of ways. Most methods which are conceivable in this respect are not attractive, however, since the products obtained, for example sodium sulphate, green liquor or white liquor, are not particularly valuable. Furthermore, it is difficult to find an outlet for such products, since it is likely that more and more cellulose pulp mills will have similar problems with the chemical balance, and will themselves have difficulty in disposing of surplus chemicals.

A more attractive solution to the problem is one where the quantity of chemicals supplied to the system does not exceed the quantity required to replace unavoidable losses. According to the invention, an internal chemical cycle is created by using oxidized white liquor in oxygen bleaching processes, and by recovering the waste liquor, thereby obviating the need of supplying alkali from outside the system. By using oxidized white liquor when bleaching with conventional bleaching agents such as chlorine and/or chlorine dioxide, the sodium and sulphur content of the bleaching waste liquor not being recovered, there is created the possibility of bleeding out both sodium and sulphur from the chemical cycle, which is an advantage. Furthermore, bleeding out of the chemicals prevents excessive enrichment of chloride in the chemicals circulating in the digestion and recovery areas. The oxidized white liquor can also be used to advantage for purifying flue gases obtained from the soda recovery boiler. Should white liquor or green liquor be used, it is possible that hydrogen sulphide which is harmful to the environment will be discharged, since the carbon dioxide content of the flue gas makes it possible to release hydrogen sulphide. The advantages to be gained by using oxidized white liquor will be clear from the above.

Figure 3:
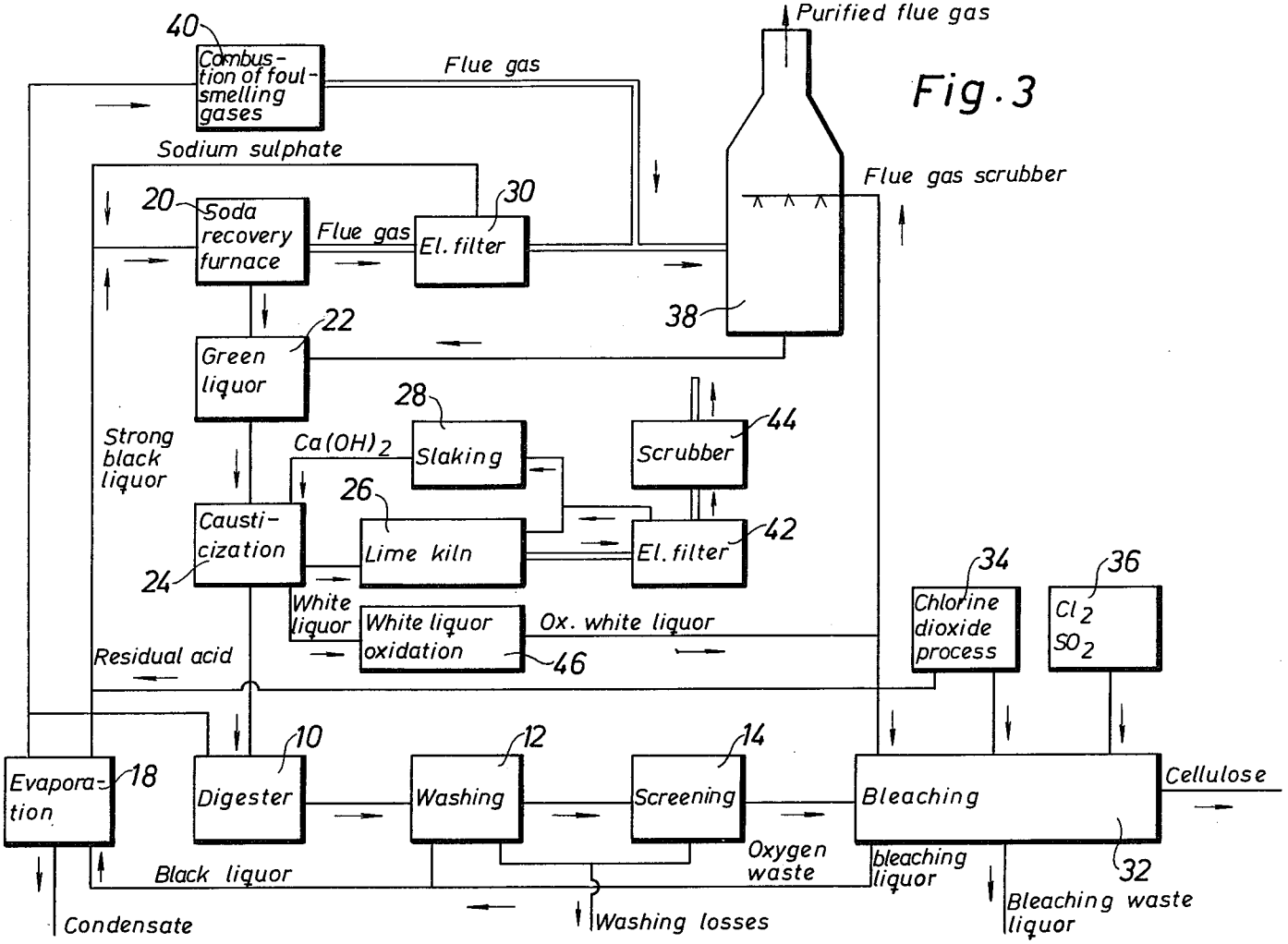
FIG. 3 is a flow scheme showing the unit operations in a sulphate pulp manufacturing plant applying the process of the present invention.

These advantages are illustrated in the flow scheme of FIG. 3, where the plant shown in FIG. 2 is complemented with a white liquor oxidation step 46. The oxidized white liquor is used (a) partly as an alkali in the bleaching section 32 instead of NaOH, as with the plant in FIG. 2, and hence only $Cl_2$ and $SO_2$ are supplied at 36, and (b) partly as a washing liquor in the flue gas scrubber 38. The flow scheme of FIG. 3 also shows that flue gas obtained from the combustion of foul-smelling gases at 40 is passed to the scrubber 38, and that waste liquor from the oxygen bleaching process in bleaching section 32 is passed to the black liquor evaporator 18.

It has surprisingly been found that white liquor can be readily oxidized on a large scale, despite the fact that tests made on laboratory scale have shown that the oxidation of sodium sulphide is quite difficult.

Several methods are available whereby a gas can be contacted by a liquid. For example bubbles of gas can be caused to pass through a liquid or a finely-divided liquid in droplet form for instance from spray nozzles, can be contacted with gas, or an ejector or venturi device can be used in which liquid and gas are mixed.

The simplest method in this respect with reference to the invention is to cause air or some other oxygen-containing gas to bubble through a layer of white liquor. This method works well in practice. In order for a good result to be obtained it is necessary to ensure, among other things, that a suitable temperature is maintained, that the contact time between the gas and the liquid phase is sufficient, and that there is a sufficiently high gas load. Sulphide can be removed quantitatively when treating white liquor in accordance with the above. An important fact is that alkali is not consumed during this treatment process.

The following Examples illustrate the oxidation of white liquor on a laboratory scale, the oxidation of white liquor on a plant scale, the use of white liquor when purifying flue gas obtained from a soda recovery boiler, and the use of white liquor when bleaching pulp with chlorine and chlorine dioxide and with an oxygen-bleaching process.

EXAMPLE 1

This Example is a laboratory test demonstrating the batchwise oxidation of white liquor with air.

The tests were made in a reactor comprising a glass tube 2 meters in height and 50 mm inner diameter. At the bottom of the reactor there was arranged a capillary having an inner diameter of 2 mm and through which air could be passed. An immersion heater was used in direct contact with the white liquor to heat the same. A cooler was mounted at the top of the reactor to reduce evaporation losses from the white liquor. 800 ml of white liquor obtained from a sulphate plant was charged to the reactor. The white liquor was heated to the desired temperature before being treated with air and the amount of $Na_2S$ in grams per liter in the treated liquor determined after the treatment. The air pressure at the top of the reactor was 1.1 bars.

Figure 4:
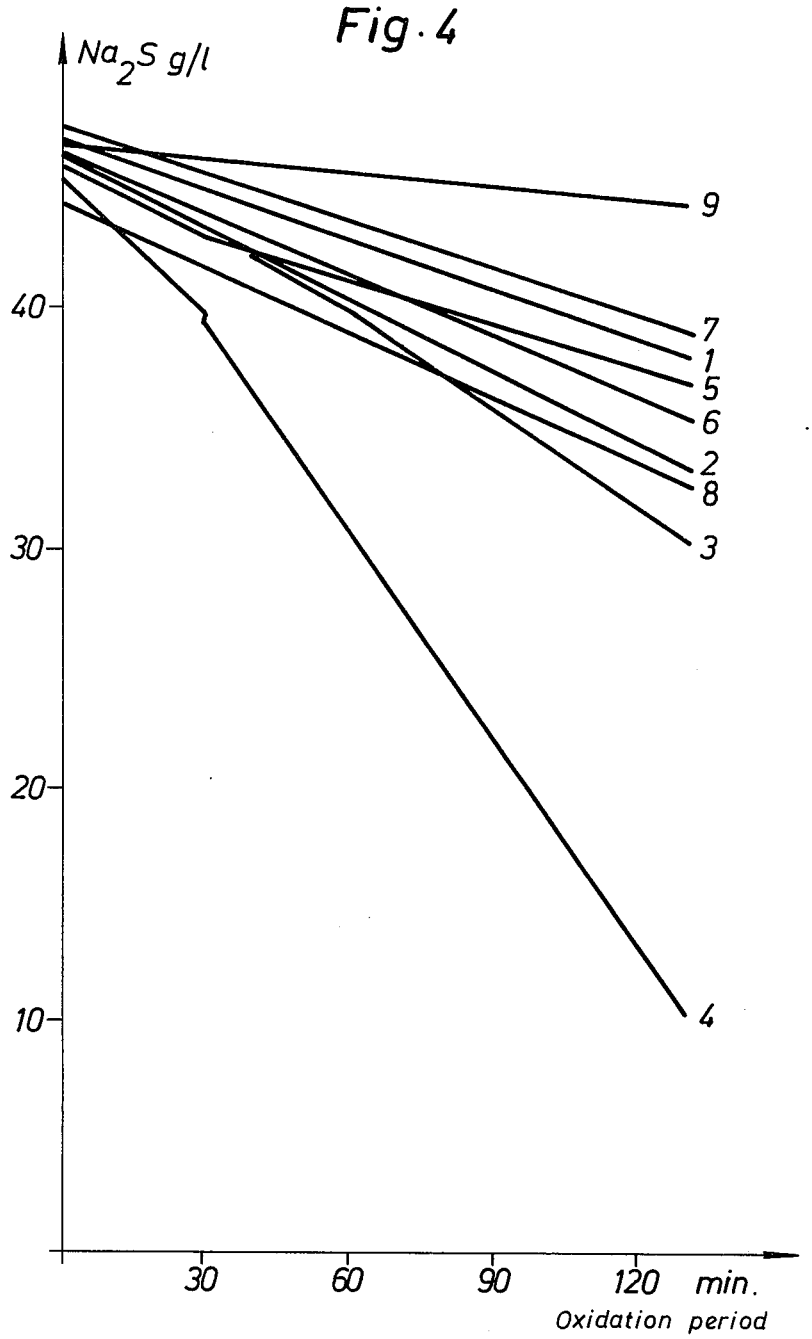
FIG. 4 is a graph showing the results obtained in Example 1 with the oxidation of white liquor.

The results obtained are given in Table I and the oxidation time in minutes for Runs 1 to 9 graphed against $Na_2S$ in g/l in FIG. 4.

From these results it is seen that an elevated temperature speeds up the sulphide oxidation, and that an increase in air supply also provides for a more rapid reaction. The reaction rate is greatly increased by adding a small quantity of black liquor. The effect obtained by the addition of other substances such as manganese, iron or nickel ions is small, as is also the effect obtained with the addition of iron shavings or filings or acid-proof steel filings. The quickest reaction without the addition of a catalyst was obtained with an air load of 600 l/h corresponding to 300 $Nm^3/hm^2$. If the load is increased further, to above roughly 500 $Nm^3/hm^2$, the liquid can no longer be retained in the reactor. Despite the high temperature, 95° C, and the high air load, a reaction time of several hours is necessary to completely convert the sulphide. The result would thus appear to indicate that a plant would need to operate at very high air loads and long residence times if no catalyst, such as black liquor, is used.

TABLE I

| Run No. | Temperature ° C | Air Flow l/h | Air Flow $Nm^3/hm^2$ | Catalyst addition | Liquid height meters | Time minutes | $Na_2S$ g/l |
|---|---|---|---|---|---|---|---|
| 1 | 95 | 200 | 100 | — | 0.6 | 0 | 47.0 |
| | | | | | | 30 | 44.5 |
| | | | | | | 60 | 43.0 |
| | | | | | | 120 | 39.2 |
| 2 | 95 | 400 | 200 | — | 0.6 | 0 | 46.4 |
| | | | | | | 30 | 43.5 |
| | | | | | | 60 | 40.8 |
| | | | | | | 120 | 34.8 |
| 3 | 95 | 600 | 300 | | 0.6 | 0 | 46.3 |
| | | | | | | 30 | 43.3 |
| | | | | | | 60 | 40.2 |
| | | | | | | 120 | 32.1 |
| 4 | 95 | 200 | 100 | Black liquor 1% | 0.6 | 0 | 45.9 |
| | | | | | | 60 | 30.0 |
| | | | | | | 120 | 14.4 |
| 5 | 95 | 200 | 100 | 5 popm Ni | 0.6 | 0 | 45.9 |
| | | | | | | 30 | 43.1 |
| | | | | | | 250 | 30.3 |
| 6 | 95 | 200 | 100 | Fe chips | 0.6 | 0 | 46.6 |
| | | | | | | 30 | 43.8 |
| | | | | | | 60 | 41.0 |
| | | | | | | 120 | 36.7 |
| 7 | 95 | 200 | 100 | Chips of stainless steel SIS 2343 | 0.6 | 0 | 47.6 |
| | | | | | | 30 | 44.7 |
| | | | | | | 60 | 43.1 |
| | | | | | | 90 | 42.4 |
| 8 | 95 | 200 | 100 | 5 ppm Mn | 0.6 | 0 | 44.3 |
| | | | | | | 0 | 42.1 |
| | | | | | | 60 | 38.7 |
| | | | | | | 120 | 33.5 |
| 9 | 50 | 400 | 200 | — | 0.6 | 0 | 47.0 |
| | | | | | | 30 | 46 |
| | | | | | | 60 | 45.5 |
| | | | | | | 120 | 45.0 |

EXAMPLE 2

This Example is a plant scale batchwise treatment of white liquor with air.

The tests were made in a reactor comprising a 6 m high vessel having a diameter of 300 mm. A gas distributor was arranged at the bottom of the reactor, to allow air or some other gas to be introduced to the reactor. Means were provided to enable the liquid in the reactor to be heated indirectly to the desired temperature by steam. The gas passing through the liquid is freed from liquid droplets before being released to atmosphere. The desired amount of white liquor was charged to the reactor and the temperature adjusted by means of steam, after which the treatment with air was commenced. The air pressure at the top of the reactor was 6 bars.

Figure 5:
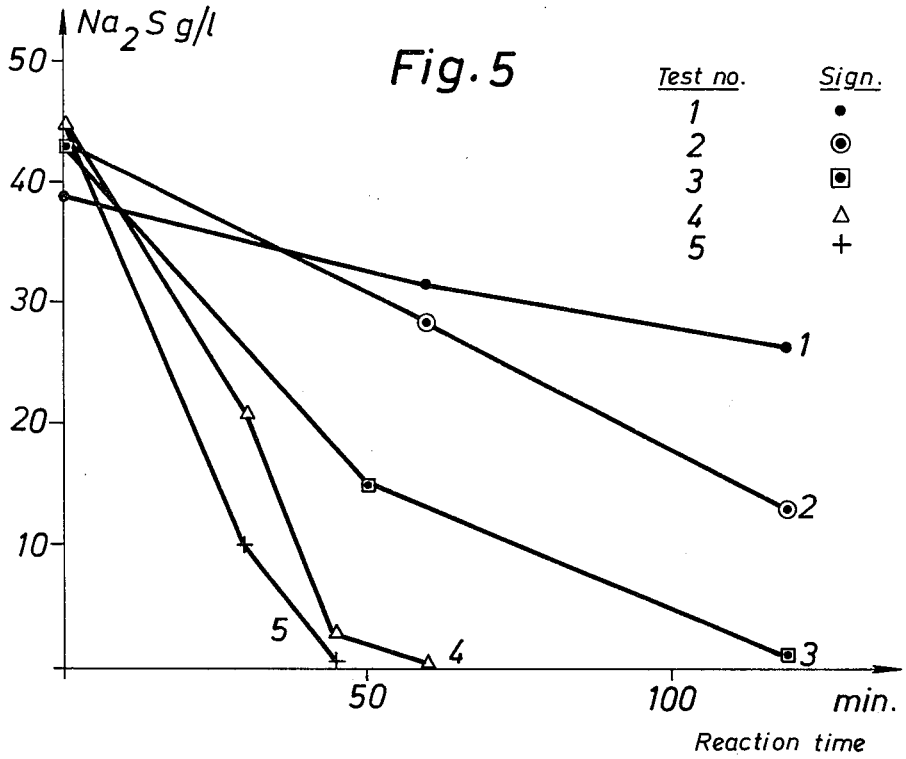
FIG. 5 is a graph showing the results obtained in Example 2 with the oxidation of white liquor using the process of the invention.

The results are shown in Table II and the reaction time in minutes is graphed against $Na_2S$ in g/l in FIG. 5.

TABLE II

| Run No. | Temperature ° C | Air Flow $Nm^3/h$ | Air Flow $Nm^3/hm^2$ | Liquid height meters | Time minutes | $Na_2S$ g/l |
|---|---|---|---|---|---|---|
| 1 | 50 | 5 | 70 | 2 | 0 | 39 |
| | | | | | 60 | 31.5 |
| | | | | | 120 | 26.5 |
| 2 | 95 | 5 | 70 | 2 | 0 | 43 |
| | | | | | 60 | 28.5 |
| | | | | | 120 | 13 |
| 3 | 95 | 5 | 70 | 5 | 0 | 43 |
| | | | | | 60 | 15 |
| | | | | | 120 | 1 |
| 4 | 95 | 35 | 400 | 2 | 0 | 45 |
| | | | | | 30 | 21 |
| | | | | | 45 | 3 |
| | | | | | 60 | 0.1 |
| 5 | 95 | 35 | 490 | 5 | 00 | 45 |
| | | | | | 30 | 10 |
| | | | | | 45 | 0.1 |

It is evident from the Table that sulphide is destroyed very rapidly, even with moderate gas loads, for example in Run No. 3, and that it is technically possible to treat white liquor with air to obtain a very low sulphide content. The tests also show that the temperature can be relatively low, around 50° C, but that it is an advantage to have a high reaction temperature from 60° to 100° C. It is also evident that it is an advantage to have a deep liquid layer. The results shown in Table II and FIG. 5 could not be anticipated from the results obtained with the tests described in Example 1. The results obtained on a large scale are surprisingly good.

The white liquor used in the tests was taken from the same white liquor tank as the white liquor used in Example 1.

EXAMPLE 3

This Example illustrates continuous treatment of white liquor with air.

Figure 6:
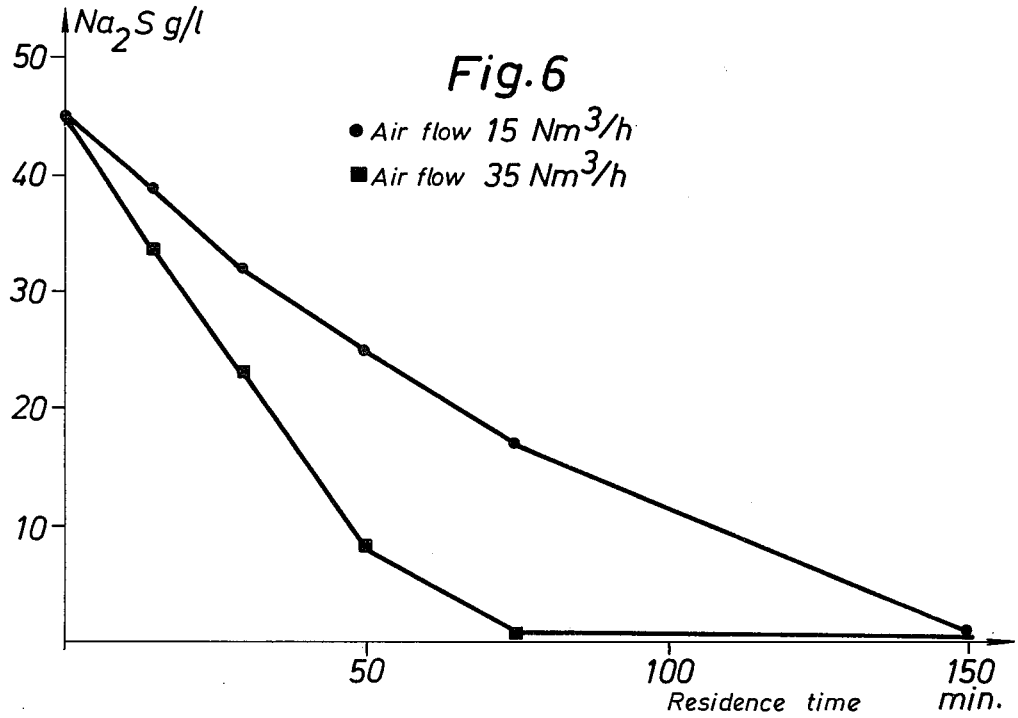
FIG. 6 is a graph showing the results obtained in Example 3 with the oxidation of white liquor using the process of the invention.

White liquor taken from the same white liquor tank as was used in Example 2 was continuously treated with air in the same reactor as that used in Example 2. The conditions for the treatment and the results obtained therewith are set forth in Table III, and the reaction time in minutes is graphed against $Na_2S$ in g/l in FIG. 6.

TABLE III

Liquid height 2.1 m
Residence volume 150 l
Temperature 95° C
Air flow 15 $Nm^3/h$
Air load 210 $Nm^3/hm^2$

| White liquor l/min. | Residence time minutes | WHITE LIQUOR ingoing $Na_2S$, g/l | WHITE LIQUOR outgoing $Na_2S$, g/l |
|---|---|---|---|
| 1 | 150 | 45.1 | 0.3 |
| 2 | 75 | 44.2 | 17 |
| 3 | 50 | 45.1 | 25 |
| 5 | 30 | 43.0 | 32 |
| 10 | 15 | 44.0 | 39 |

Liquid height 2.1 in
Residence volume 150 l
Temperature 95° C
Air flow 35 $Nm^3/h$
Air load 490 $Nm^3/hm^2$

| White liquor 1/min. | Residence time minutes | WHITE LIQUOR ingoing $Na_2S$, g/l | WHITE LIQUOR outgoing $Na_2S$, g/l |
|---|---|---|---|
| 1 | 150 | 44.8 | 0.1 |
| 2 | 75 | 45.2 | 0.5 |
| 3 | 50 | 44.5 | 8 |
| 5 | 30 | 43.9 | 23 |
| 10 | 15 | 44.8 | 33.5 |

The results show that it is possible to treat white liquor with air in a continuous process. The sulphide concentration in the liquor leaving the reactor is approximately inversely proportional to the residence time, if the remaining conditions, i.e., temperature and air flow, are constant. Thus, the reaction rate under the described test conditions is constant. This permits a free choice between a batchwise or continuous process.

EXAMPLE 4

This Example illustrates the use of sodium hydroxide, white liquor and oxidized white liquor as the washing liquor in a flue gas scrubber.

The different washing liquors were compared by tests in the type of flue gas scrubber described in Swedish Pat. No. 308,657:

| | |
|---|---|
| Flue gas volume | 100,000 $Nm^3/h$ |
| Ingoing flue gas | hydrogen sulphide concentration 0 to 10 $mg/Nm^3$<br>sulphur dioxide concentration 1000 to 3000 $mg/Nm^3$ |
| Alkali consumption | 540 kg NaOH/h |

The alkali consumption, calculated as sodium hydroxide, was held constant, the pH in the circulating washing liquor being 6.8–7.0.

The following results were obtained:

TABLE IV

| Washing liquor | Outgoing flue gas $H_2S$ $mg/Nm^3$ | Outgoing flue gas $SO_2$ $mg/Nm^3$ |
|---|---|---|
| Sodium hydroxide | 0 – 6 | 100 – 300 |
| White liquor | 30 – 100 | 100– 300 |
| Oxidized white liquor | 0 – 7 | 80 – 320 |

The results show that the different washing liquors are equally effective for absorption of sulphur dioxide. The results also show that white liquor, which contains sulphide, gives rise to an extremely high hydrogen sulphide emission, which is extremely unsuitable with respect to the care and protection of the environment. The tests also show that oxidized white liquor is fully equivalent to sodium hydroxide in the present context.

EXAMPLE 5

An unbleached pine sulphate pulp having a kappa number of 34.7 (SCAN-C 1:59) and a viscosity of 1181 $cm^3/g$ (SCAN) was bleached in accordance with the sequence C E C/D E D, where the designations are:

| | |
|---|---|
| C | Chlorine treatment |
| E | Alkali treatment |
| C/D | Treatment with a mixture of chlorine and chlorine dioxide |
| D | Chlorine dioxide treatment |

The bleaching treatment was according to the following:

TABLE V

| Step | C | E | C/D | E | D |
|---|---|---|---|---|---|
| Pulp concentration, % | 3.5 | 8 | 5 | 8 | 6 |
| Time, hours | 1 | 2 | 3 | 2 | 5 |
| Temperature, ° C | 20 | 50 | 50 | 50 | 80 |
| Chlorine charge, % (as active chlorine) | 7.65 | — | 2.0 | — | 2.0 |
| Alkali, % NaOH | — | 2.8 | — | 1.0 | — |
| $Cl_2/ClO_2$ ratio | — | — | 85/15 | — | — |

Three test series were carried out, the alkali charge comprising one of the following:

| | |
|---|---|
| A | NaOH |
| B | White Liquor |
| C | Oxidized white liquor |

The following results were obtained with pulps treated according to the three alternatives:

| | | A | B | C |
|---|---|---|---|---|
| Brightness | (SCAN) | 92 | 88 | 92 |
| Viscosity | (SCAN) | 949 | 930 | 940 |

The results show that alternatives A and C are equivalent. Alternative B using white liquor clearly produces a lower degree of brightness and viscosity.

EXAMPLE 6

An unbleached pine sulphate pulp having a kappa number of 33 (according to SCAN-C 1:59) and a viscosity of 1230 $cm^3/g$ (SCAN) was bleached according to the sequence O C/D E D E D, the designations being:

| | |
|---|---|
| O | Oxygen-gas treatment |
| C/D | Treatment with a mixture of chlorine and chlorine dioxide |
| E | Alkali treatment |
| D | Chlorine dioxide treatment |

The conditions were as follows:

TABLE VI

| Step | O | C/D | E | D | E | D |
|---|---|---|---|---|---|---|
| Pulp concentration, % | 30 | 5 | 8 | 6 | 8 | 6 |
| Time, hours | 0.5 | 3 | 2 | 3 | 2 | 5 |
| Temperature, ° C | 100 | 50 | 50 | 75 | 50 | 80 |
| Chlorine charge, % (as active chlorine) | — | 4.15 | — | 0.9 | — | 0.6 |
| Alkali, % NaOH | 3 | — | 1.5 | — | 0.9 | — |
| $Cl_2/ClO_2$ ratio | — | 85/15 | — | — | — | — |
| The oxygen-gas pressure $kp/cm^2$ | 5 | — | — | — | — | — |

Three series of tests were carried out, in which pulps were treated with one of the three following alkali charges, with the following results:

| | | A NaOH | B White Liquor | C Oxidized White Liquor |
|---|---|---|---|---|
| Brightness | (SCAN) | 93 | 87 | 93 |
| Viscosity | (SCAN) | 902 | 850 | 900 |

Thus, the results for A and C show that pure NaOH and oxidized white liquor afford the same result, i.e., they can be substituted for each other in any desired proportion. The use of normal white liquor B, on the other hand, produces a much poorer result. Furthermore, strict safety measures must be taken to ensure that no hydrogen sulphide forms. This gas is particularly poisonous and is released from solutions containing sulphides if the solutions are mixed with solutions having a low pH, e.g. waste liquor from step C/D or step D.

The Examples show that various methods can be used to oxidize white liquor and that the proposed fields of use are realistic. Prior to the oxidation step, the white liquor used in the tests had a sodium sulphide content of 35 to 50 g $Na_2S$ per liter, a sodium thiosulphate content of 5 to 10 g $Na_2S_2O_3$ per liter, and a content of titratable alkali expressed as sodium hydroxide of 100 to 130 g/l.

Subsequent to oxidizing the white liquor, it was possible to reduce the sulphide content of 0 to 1 g $Na_2S$ per liter, the sodium thiosulphate content was 35 to 50 g $Na_2S_2O_3$ per liter, and the alkali content expressed as NaOH was 100 to 130 g/l.

Tests carried out on a full scale show that it is an advantage to use a high liquid column, over 5 meters, through which air can flow and that the reaction rate increases if pure oxygen gas or air under elevated pressure is used. The air pressure must be greater than that caused by the height of the liquid column, in order for the air to pass through the reactor. For practical reasons it may be suitable, however, to establish a relatively low overpressure at the top of the reactor, so that the pressure prevailing at the top of the reactor is only as high as that necessary to enable the separation of liquid droplets in a demister, and which results from the conduit system in which the residual gas is passed to atmosphere. Thus, an air pressure of up to 5 bars usually is suitable, but higher pressures may in certain circumstances be advantageous.

It is, of course, possible to use other methods for contacting the gas and liquid than the method of blowing air into the white liquor through a perforated gas distributor. For example, an air lift pump can be used to further improve the contact between gas and liquid. The air may also be atomized by mechanical devices of another type, e.g. rotating discs or propellers. Research carried out during the development of the present invention has shown, however, that a sufficiently good result is obtained with a gas distributor provided with small orifices, excessively small orifices being unsuitable owing to the risk of blockages occurring and owing to a high pressure drop. Excessively large orifices are also unsuitable owing to the fact that with large orifices the contact between liquid and gas is poor. A suitable orifice diameter is from 1 to 10 mm.

It has been found that when using chlorine and/or chlorine dioxide, particularly with oxygen-gas bleaching processes, the presence of trace substances, such as iron, cobalt, nickel and manganese, for example, can influence the quality of the pulp. Consequently it is, in certain instances, convenient to remove solid particles from the oxidized white liquor by filtering, or decanting. To remove from the white liquor foreign substances dissolved therein, chemicals can be added which form flocs on which the impurities are absorbed. Chemicals which can be used in this way include magnesium, zinc and calcium compounds. Polyelectrolytes or silicates can be used instead of or in combination with these chemicals.

To improve efficiency of the oxidation process, several reactors can be connected together in series, the white liquor being passed from one to the other of the reactors in series. Air can also be caused to pass through the reactors in series, or alternatively, fresh air can be charged to each reactor. If the white liquor is very pure, it may be difficult to get the sulphide to react. In this case it is suitable to add catalysts, such as iron, manganese or nickel compounds or organic substances, such as black liquor, to expedite the oxidation process.

Having regard to the foregoing disclosure, the following is claimed as the inventive and patentable embodiments thereof:

1. In the cyclic process for utilizing sodium values in sulfate cellulose pulping, in which sodium losses normally are less than sodium additions to the process, thus tending to build up a sodium surplus, and which includes the steps of pulping cellulosic material with a pulping liquor comprising sodium hydroxide and sodium sulfide, separating spent pulping black liquor containing sodium values, evaporating and combusting the black liquor to recover sodium values as sodium sulfide and sodium carbonate, dissolving the sodium sulfide and sodium carbonate in water to form green liquor, causticizing the green liquor with calcium hydroxide to form white liquor, and recycling white liquor to form pulping liquor, the improvement which comprises maintaining sodium balance at least in part by removing sodium values as white liquor, oxidizing the white liquor with a free oxygen-containing gas at a temperature within the range from about 50° to about 130° C by injecting a free oxygen-containing gas at a flow to maintain the white liquor in motion within the range from about 50 to about 500 $Nm^3/hm^2$ while maintaining the aqueous solution at a depth of least 2 meters above the point at which the gas is injected into the solution for a time to convert substantially all sodium sulfides to sodium thiosulfates, and utilizing the oxidized sodium thiosulfate-containing white liquor as a source of alkali outside the cyclic process for sulfate cellulose pulping.

2. A process in accordance with claim 1 in which the white liquor is oxidized at a temperature within the range from about 70° to about 110° C by injecting air into the solution while maintaining the air flow at a rate to agitate the solution within the range from about 100 to about 400 $Nm^3/hm^2$, the pressure of the air at the top of the reactor exceeding atmospheric pressure by at most 5 bars.

3. A process in accordance with claim 1 in which sodium values in the spent oxidized white liquor are recovered by combining the spent oxidized white liquor with spent pulping black liquor, and then recovering the sodium values of both.

4. A process in accordance with claim 1 in which the oxidation is carried out in the presence of black liquor; thereby promoting the oxidation of sodium sulfide to sodium thiosulfate.

5. A process in accordance with claim 1 which comprises removing the oxidized white liquor and washing flue gases from black liquor combustion therewith.

6. A process in accordance with claim 1 which comprises passing the oxidized white liquor to an alkaline oxygen gas bleaching process.

7. A process in accordance with claim 1 which comprises passing the oxidized white liquor to a cellulose pulp bleaching process utilizing a chlorine compound.

8. A process in accordance with claim 1 which comprises reacting the oxidized white liquor with waste gases obtained from a cellulose pulp bleaching porcess to destroy chlorine residues or chlorine dioxide.

9. A process in accordance with claim 1 which comprises passing the oxidized white liquor to an ion exchanger for regeneration thereof.

10. A process in accordance with claim 1 which comprises neutralizing sulfite waste liquor with the oxidized white liquor.

11. A process in accordance with claim 1 which comprises oxidizing the white liquor at a temperature within the range from about 50° to about 130° C by injecting a free oxygen-containing gas at a flow to maintain the white liquor in motion within the range from about 100 to about 400 $Nm^3/hm^2$.

12. A process in accordance with claim 1, which comprises maintaining the aqueous solution at a depth of at least 5 meters above the point at which the gas is injected into the solution.

13. A process in accordance with claim 11, which comprises maintaining a superatmospheric pressure of free oxygen-containing gas up to 10% higher than atmospheric pressure.

14. A process in accordance with claim 11, which comprises atomizing the free oxygen-containing gas by injecting the gas into the liquor through orifices having a diameter of from 1 to 10 mm.

15. A process in accordance with claim 1, which comprises carrying out the oxidation in the presence of a catalyst which promotes the oxidation of sulphide to thiosulphate.

16. A process in accordance with claim 15, in which the catalyst in black liquor.

17. A process in accordance with claim 1, which comprises removing solid particles from the oxidized white liquor.

18. A process in accordance with claim 17, which comprises flocculating the oxidized white liquor by adding thereto a magnesium, calcium or zinc compound reactive with an anion therein selected from the group consisting of hydroxide and carbonate, and forming therewith a compound selected from the group consisting of the corresponding hydroxide and carbonate.

19. A process in accordance with claim 17, which comprises flocculating the oxidized white liquor by adding thereto a liquor-insoluble compound selected from the group consisting of silicates and polyelectrolytes.

* * * * *

UNITED STATES PATENT OFFICE

CERTIFICATE OF CORRECTION

Patent No. 4,053,352 Dated October 11, 1977

Inventor(s) Bengt Goran Hultman, et al.

It is certified that error appears in the above-identified patent and that said Letters Patent are hereby corrected as shown below:

| | |
|---|---|
| Column 3, line 63 : | "carred" should be --carried-- |
| Column 7, line 39 : under heading "Catalyst addition" | "5 popm" should be --5 ppm-- |
| Column 7, line 48 : under heading "Time in Minutes" | "0" should be --30-- |
| Column 8, line 19 : under heading "$Nm^3/hm^2$" | "400" should be --490-- |
| Column 9, line 1 : | "in" should be --m-- |
| Column 12, line 67: | "porcess" should be --process-- |
| Column 14, line 8 : | "in" should be --is--. |

Signed and Sealed this

Tenth Day of July 1979

[SEAL]

Attest:

LUTRELLE F. PARKER

Attesting Officer Acting Commissioner of Patents and Trademarks